US008703378B2

(12) United States Patent
Satoh et al.

(10) Patent No.: US 8,703,378 B2
(45) Date of Patent: Apr. 22, 2014

(54) METHOD OF MANUFACTURING TONER AND TONER MANUFACTURED BY THE METHOD

(75) Inventors: Kohsuke Satoh, Shizuoka (JP); Tetsuya Tanaka, Shizuoka (JP); Masahiro Kawamoto, Shizuoka (JP); Natsuko Matsushita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 190 days.

(21) Appl. No.: 13/234,718

(22) Filed: Sep. 16, 2011

(65) Prior Publication Data

US 2012/0070774 A1 Mar. 22, 2012

(30) Foreign Application Priority Data

Sep. 16, 2010 (JP) ..... 2010-208586

(51) Int. Cl.
*G03G 9/08* (2006.01)

(52) U.S. Cl.
USPC ..... 430/137.1; 430/105; 430/137.18; 430/111.4

(58) Field of Classification Search
USPC ..... 430/105, 137.1–137.21
See application file for complete search history.

(56) References Cited

U.S. PATENT DOCUMENTS

| | | | | |
|---|---|---|---|---|
| 2008/0107992 | A1* | 5/2008 | Shimmura | 430/110.4 |
| 2008/0159777 | A1* | 7/2008 | Fuwa et al. | 399/107 |
| 2010/0104971 | A1* | 4/2010 | Yuasa et al. | 430/137.14 |
| 2010/0159374 | A1* | 6/2010 | Mutoh et al. | 430/105 |

FOREIGN PATENT DOCUMENTS

| | | |
|---|---|---|
| CN | 1755531 A | 4/2006 |
| JP | 63-139366 | 6/1988 |
| JP | 2627497 | 4/1997 |
| JP | 9-230622 | 9/1997 |
| JP | 10-10781 | 1/1998 |
| JP | 10-95855 | 4/1998 |
| JP | 2005-270955 | 10/2005 |

(Continued)

OTHER PUBLICATIONS

NOB 300 Data Sheet, http://beta.globalspec.com/SpecSearch/PartSpecs?partId={3D3CC073-9E44-4207-8E79-C6ACC8FABB10}&comp=1579&vid=156682&regevent=new, GlobalSpec, Inc., 1999, 30 Tech Valley Dr Suite 102, East Greenbush, NY 12061.*

(Continued)

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A method of manufacturing toner including mixing mother toner particles containing a binder resin and a coloring agent and first particles having an average primary particle diameter of from 100 nm to 1 μm to using a mixer including a rotary shaft member, multiple stirring members provided to the surface of the shaft member, and a casing to cover the multiple stirring members, wherein the cross section of the inner periphery of the casing relative to a direction perpendicular to the rotation axis of the shaft member is circular around the rotation axis with a substantially constant distance between the inner periphery and the rotation axis. The casing covers the multiple stirring members and a cooling jacket is provided to at least part of the outer periphery of the casing. The weight ratio of the particles to the mother toner particles is from 1.5% to 10%.

20 Claims, 2 Drawing Sheets

(56) References Cited

FOREIGN PATENT DOCUMENTS

| | | |
|---|---|---|
| JP | 2006-72121 | 3/2006 |
| JP | 3979589 | 7/2007 |
| JP | 2008-65285 | 3/2008 |
| JP | 2009-69640 | 4/2009 |

OTHER PUBLICATIONS

Chinese Office Action issued Aug. 30, 2012 in Patent Application No. 201110272994.9.

* cited by examiner

METHOD OF MANUFACTURING TONER AND TONER MANUFACTURED BY THE METHOD

CROSS-REFERENCE TO RELATED APPLICATIONS

This patent application is based on and claims priority pursuant to 35 U.S.C. §119 to Japanese Patent Application No. 2010-208586, filed on Sep. 16, 2010, in the Japan Patent Office, the entire disclosure of which is hereby incorporated by reference herein.

BACKGROUND OF THE INVENTION

1. Field of the Invention

The present invention is related to a method of manufacturing toner and toner. Manufactured by the method 2. Description of the Background Art Image forming apparatuses such as photocopiers and printers that produce quality images at a high speed continue to be in great demand. In keeping with this trend, improved thermal and/or mechanical stress resistance is required of toner used in such apparatuses, whether the toner is one-component development agents or two-component development agents. In particular, the physical force of attachment between toner particles and either carrier particles or a development agent bearing member during the electrophotographic development process contributes to good development of images. However, additives present on mother toner particles are embedded therein by the thermal and/or mechanical stress applied to the particles at a development unit during development, resulting in an increase of the physical force of attachment, which in turn causes problems such as reduction of the developability and/or transferability, non-uniform transfer, degradation of fluidity, non-uniform charge, and vulnerability to environmental changes.

To solve these problems, there is a method that provides particles having a larger diameter than that of the additives are used in combination. However, such particles are not able to reduce embedding of the additives unless such particles are fixed on the surface of mother toner particles in at least a certain amount.

Since particles having a larger diameter than that of the additives have a small specific surface area, the added amount of the particles are required to increase in some degree and also the particles are required to be fixed on the surface of mother toner particles. In particular, in the case of a polymerized toner having a core-shell structure for low temperature fixing with a surface having no releasing agent present on mother toner particles, it is difficult to fix such large-diameter particles on the mother toner particles.

At the same time, additives can be fixed on the surface of mother toner particles by various known methods. For example, Japanese patent application publication No. S63-85756 (JP-S63-85756-A) describes a method of attaching inorganic fine powder to the surface of core material by mechanical and thermal energy using mainly impact power. JP-S63-139366-A describes a method of removing fine powder of silicic acid not attached to mother toner particles. JP-H10-10781-A describes a method of instantaneously heating a mixture of thermoplastic particles and additives without contact in the atmosphere ranging from the softening point of the thermoplastic resin to 300° C. higher than that JP-H10-95855-A describes a method of using a spherical mixer having a lower rotation wing rotating along the basal plane of the spherical vessel and an upper rotation wing provided at the center thereof rotating at a peripheral speed of 40 m/s or higher.

Further, JP-2005-270955-A describes a method of using a processor that is provided with a rotary shaft with two or more agitation members installed in a circumference section, and a casing having the inner circumference section located apart from the agitation members at a minute interval, such that, when the treatment apparatus is viewed from the direction orthogonal to the axial direction of the rotary shaft, the end position of each of the agitation members in the direction parallel to the axial direction of the rotary shaft is located inside of the other adjacent agitation members rather than at the end position of the other agitation members.

JP-2004-77593-A describes a method of manufacturing an electrophotographic toner in which toner matrix particles consisting essentially of a binder resin, a colorant, and a releasing agent, and an electrostatic charge controlling agent, are stirred together by rotating a rotator having stirring blades in a fluidized stirring-type mixing apparatus to fix the electrostatic charge controlling agent on the surfaces of the toner matrix particles. The rotator is rotated at 65 to 120 m/s peripheral speed within a temperature range of $Tg-10>T>Tg-35$ (where T is the temperature (° C.) of the internal atmosphere of the apparatus during stirring and Tg is the glass transition temperature (° C.) of the resin powder).

JP-2009-69640-A describes a method of manufacturing an electrophotographic toner to fix a charge control agent to the surface of the mother toner particle by a flowing and stirring type mixer in which a mixture of 100 parts by weight of the mother toner particle, 0.3 to 1.0 part by weight of a charge control agent having a primary particle diameter of from 5 to 1,000 nm, and an inorganic particulate having a specific surface area diameter of from 5 to 300 nm are stirred in a range satisfying the relation $Tg-50<T<Tg-15$ (where T represents a temperature (° C.) of the atmosphere in the flowing and stirring type mixer during stirring and Tg represents the glass transition temperature (° C.) of the mother toner particle). The flowing and stirring type mixer has a rotation axis, multiple stirring members, a casing having a circular wall face with a constant distance from the rotation axis, and a cooling jacket. In addition, the multiple stirring members are provided to the rotation axis in such a manner that the stirring members rotate in three or more different circular paths having diameters of from 90 to 1,000 mm at a peripheral speed of from 10 to 150 m/s. Furthermore, the clearance C (mm) between at least one of the multiple stirring members and the circular wall face and the diameter D (mm) of the maximum circular path among the circular paths satisfies the relation $2.5 \leq D^{1/2}/C < 9.0$. The mother toner particle contains a binder resin, a coloring agent, and a releasing agent, and has a weight average particle diameter D4 of from 3 to 9 μm.

Finally, JP-H09-230622-A describes a method of manufacturing electrophotographic toner formed by admixing particulates with colored particles consisting of at least a resin and a colorant, wherein the toner has a mean particle size by volume of from 50 to 1,000 nm and organic particulates having frictional charging characteristics of the same polarity as the colored particles with regard to a frictional charging member are fixed to the surfaces of the colored particles, followed by admixing inorganic particulates having a mean particle size by volume of from 5 to 50 nm.

Although these methods are successful to some extent, they are unsatisfactory with regard to the amount of the large-diameter particles that are fixed on the surface of the mother toner particles. As a result, these additives gradually bury into the mother toner particles during image formation over a long period of time.

SUMMARY OF THE INVENTION

In view of the foregoing, the present invention provides a novel method of manufacturing toner including mixing mother toner particles containing a binder resin and a coloring agent and first particles having an average primary particle diameter of from 100 nm to 1 μm to obtain a mixture of the mother toner particles and the first particles using a mixer having a rotary shaft member, multiple stirring members provided to the surface of the shaft member, and a casing to cover the multiple stirring members, wherein a cross section of the inner periphery of the casing relative to the direction perpendicular to the rotation axis of the shaft member is circular around the rotation axis with a substantially constant distance between the inner periphery and the rotation axis in a state in which the casing covers the multiple stirring members and a cooling jacket is provided to at least part of the outer periphery of the casing and wherein the weight ratio of the particles to the mother toner particles is from 1.5% to 10%.

It is preferred that the method of manufacturing the toner further includes mixing the mixture of the mother toner particles and the first particles with second particles having an average primary particle diameter of from 10 nm to less than 100 nm.

It is still further preferred that, in the method of manufacturing toner described above, the mixer is used in the step of mixing the mixture of the mother toner particles and the first particles with the second particles.

It is still further preferred that, in the method of manufacturing toner described above, the weight ratio of the second particles to the mother toner particles is from 0.1% to 5%.

It is still further preferred that, in the method of manufacturing toner described above, the temperature of an atmosphere in the casing is from 50° C. lower than the glass transition temperature of the binder resin to 15° C. lower than the glass transition temperature.

It is still further preferred that, in the method of manufacturing toner described above, the multiple stirring members including at least one first stirring member and at least one second stirring member, the first stirring member transferring the particles in a first direction substantially parallel to the rotation axis of the shaft member and the second stirring member transferring back the particles in a second direction counter to the first direction.

It is still further preferred that, in the method of manufacturing toner described above, adjacent stirring members of the multiple stirring members are arranged overlapped in the direction substantially parallel to the rotation axis of the shaft member and offset from each other circumferentially in a circumferential direction of the shaft member.

It is still further preferred that, in the method of manufacturing toner described above, the casing has a cylindrical form.

It is still further preferred that, in the method of manufacturing toner described above, the rotation axis of the shaft member is substantially orthogonal to a vertical direction (nearly equal to the direction of gravity).

It is still further preferred that, in the method of manufacturing toner described above, the mother toner particle further contains a releasing agent.

It is still further preferred that, in the method of manufacturing toner described above, the mother toner particle has a glass transition temperature of from 40° C. to 65° C.

It is still further preferred that, in the method of manufacturing toner described above, the mother toner particle has a volume average particle diameter of from 3 μm to 9 μm.

As another aspect of the present invention, a method of manufacturing toner is provided which includes mixing mother toner particles containing a binder resin and a coloring agent, first particles having an average primary particle diameter of from 100 nm to 1 μm, and second particles having an average primary particle diameter of from 10 nm to less than 100 nm using a mixer having a rotary shaft member, multiple stirring members provided to a surface of the shaft member, and a casing capable to cover the multiple stirring members, wherein the cross section of an inner periphery of the casing relative to a direction perpendicular to the rotation axis of the shaft member is circularly around the rotation axis with a substantially constant distance between the inner periphery and the rotation axis in a state in which the casing covers the multiple stirring members and a cooling jacket is provided to at least part of the outer periphery of the casing and wherein the weight ratio of the first particles to the mother toner particles is from 1.5% to 10%.

It is preferred that, in the method of manufacturing toner described above, the weight ratio of the second particles to the mother toner particles is from 0.1% to 5%.

As another aspect of the present invention, a method of manufacturing toner is provided which includes mixing mother toner particles containing a binder resin and a coloring agent and second particles having an average primary particle diameter of from 10 nm to less than 100 nm to obtain a mixture of the mother toner particles and the second particles and mixing the mixture and first particles having an average primary particle diameter of from 100 nm to 1 μm using a mixer having a rotary shaft member, multiple stirring members provided to the surface of the shaft member, and a casing capable to cover the multiple stirring members, wherein the cross section of the inner periphery of the casing relative to a direction perpendicular to the rotation axis of the shaft member is circularly around the rotation axis with a substantially constant distance between the inner periphery and the rotation axis in a state in which the casing covers the multiple stirring members and a cooling jacket is provided to at least part of the outer periphery of the casing and wherein the weight ratio of the first particles to the mother toner particles is from 1.5% to 10%.

It is preferred that, in the method of manufacturing toner described above, the mixer is used in the step of mixing the mother toner particles and the second particles to obtain the mixture.

It is still further preferred that, in the method of manufacturing toner described above, the weight ratio of the second particles to the mother toner particles is from 0.1% to 5%.

As another aspect of the present invention, a toner is provided which is manufactured by any of the method of manufacturing toner described above.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

Next, embodiments of the present disclosure are described with reference to accompanying drawings.

Figure 1:
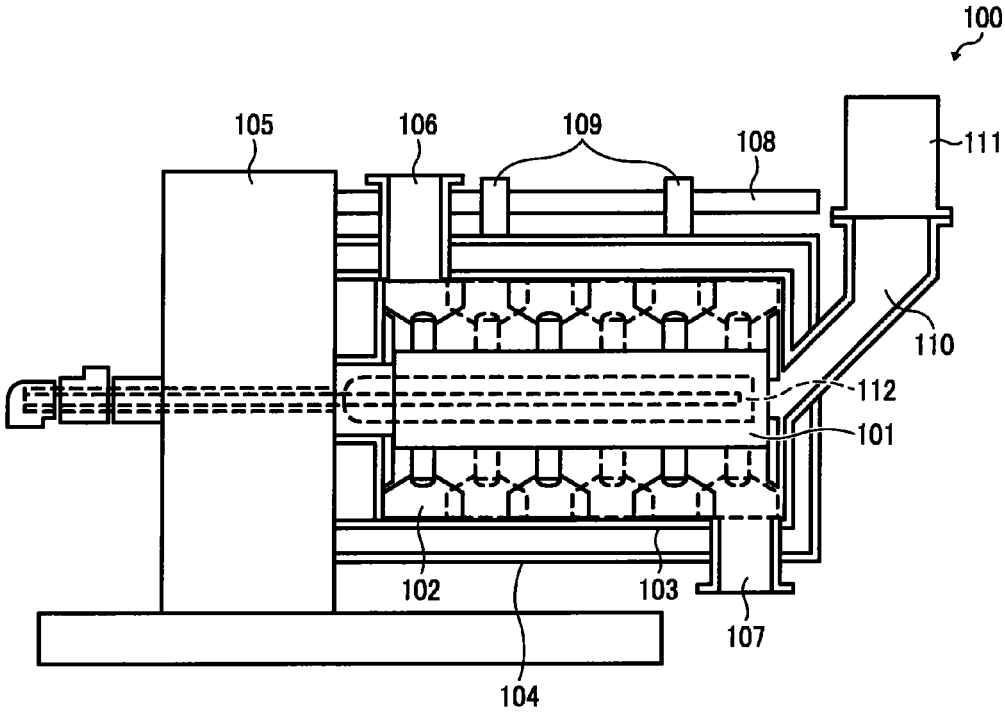
FIG. 1 is a schematic diagram illustrating an example of the mixer of the present disclosure.

FIG. 1 is a diagram illustrating an example of the mixer for use in the present disclosure. A mixer 100 includes a shaft member 101, multiple stirring members 102 provided on the surface of the shaft member 101, and a casing 103 that can cover the stirring members 102.

The casing 103 is of a cylindrical form and the inner periphery thereof is arranged circularly around the rotation axis of the shaft member 101, therefore with a constant distance therefrom in a state in which the casing 103 covers the stirring members 102. The casing 103 has a cooling jacket 104 provided to the outer periphery to flow a cooling medium.

Therefore, it is possible to efficiently mix and cool down particles by placing the particles in the casing 103 and rotating the shaft member 101 in a state in which the stirring members 102 are covered by the casing 103.

In addition, since the rotation axis of the shaft member 101 is arranged substantially orthogonal relative to the vertical direction (nearly equal to direction of gravity), the particles are uniformly mixed.

Substantially orthogonal (or parallel) allows an error of about 5 degrees from the vertical (or horizontal) direction.

Figure 2:
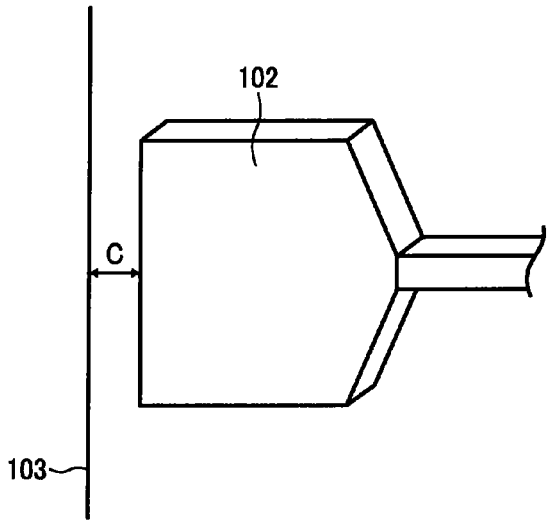
FIG. 2 is a schematic diagram illustrating the stirring member illustrated in FIG. 1.

As illustrated in FIG. 2, the stirring members 102 are arranged with a clearance C from the inside wall (inner periphery) of the casing 103. Therefore, particles inside the casing 103 can be mixed by rotation of the shaft member 101 having a surface to which the stirring members 102 are provided. The clearance C is typically from 0.3 mm to 50 mm.

The internal diameter of the casing 103 is preferably twofold or less relative to the outer diameter of the axis-form 101. In this designing, a force of stirring by the stirring members 102 is strongly transmitted to particles.

One side of the shaft member 101 is supported by a shaft bearing 105 and connected to a driving force (not shown) such as a motor. An inlet 106 from which particles to be mixed are inserted is provided at the upper portion of the end on the side where the shaft bearing 105 of the casing 103 is provided. An outlet 107 from which the mixed particles are discharged is situated at the lower portion of the opposing end of the bearing shaft 105 of the casing 103 relative to the inlet 106 of the casing 103.

The shaft member 101 is supported only at one end (left side in FIG. 1) in the direction substantially parallel to the rotation axis and the casing 103 is of a cylindrical form which has an only opening (left side in FIG. 1) in the direction substantially parallel to the rotation axis of the shaft member 101 while the other end is closed (right side in FIG. 1). In addition, the casing 103 is supported by a guide bar 108 and bosses 109 and arranged movable in the direction substantially parallel to the rotation axis of the shaft member 101 between the operation position (refer to FIG. 1) at which the stirring members 102 are covered and a non-operation position (not shown) at which the stirring members 102 are not covered.

The casing 103 has an air release pipe 110 to release the pressure increased by swelling of air caused by temperature rise in the casing 103 or seal air of the axis seal portion (not shown) of the shaft member 101.

In addition, the air release pipe 110 has a filter 111 to reduce scattering of powder dust. Furthermore, the shaft member 101 has a flow path 112 inside thereof to flow a cooling medium.

The stirring member 102 has a paddle form arranged substantially parallel to the rotation axis of the shaft member 101 and six of the stirring members 102 are provided to the surface of the shaft member 101.

Three of the stirring members 102 are arranged substantially parallel to the rotation axis of the shaft member 101 and two are arranged in the rotation direction of the shaft member 101 in the parallel direction×2 in the rotation direction=6). In addition, each of the stirring members 102 is provided symmetrical with respect to a point.

Three or more of the stirring members 102 can be provided in the direction substantially parallel to the rotation axis of the shaft member 101. When one or two of the stirring members 102 are provided and arranged parallel to the rotation axis of the shaft member 101, mother toner particles and other particles are not easily stirred uniformly, meaning that these particles are not evenly dispersed or the first particles are not uniformly fixed on the mother toner particles.

The adjacent stirring members 102 are arranged overlapped in the direction parallel to the rotation axis of the shaft member 101 and away from each other in the rotation direction of the shaft member 101.

Consecutively, the particles are moved from the end of the stirring member 102 to the inner side of the adjacent stirring member 102 so that the force of stirring by the stirring member 102 is strongly transmitted to the particles.

There is no specific limit to the form of the stirring member 102 and the stirring member 102 may have a board form, a ditch form, etc. other than the paddle form.

Figure 3:
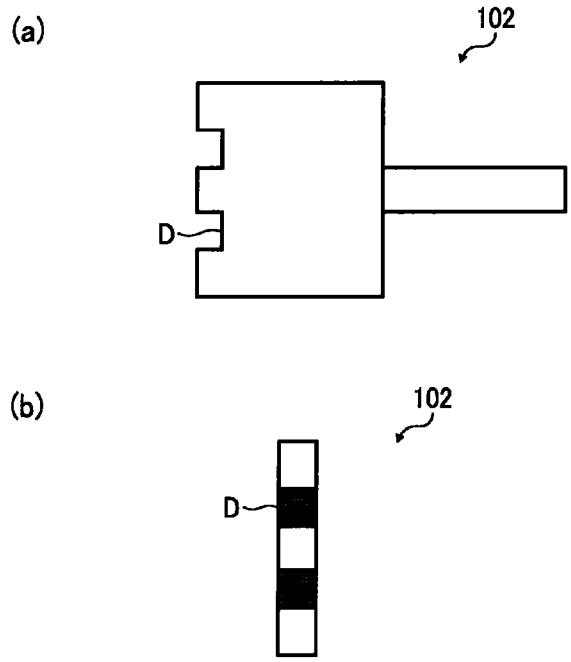
FIG. 3 is a schematic diagram illustrating an example in which the stirring member illustrated in FIG. 1 has ditches.

The stirring member 102 may have ditched portions D opposing the inside wall of the casing 103 as illustrated in FIG. 3.

FIG. 3A and FIG. 3B are a side view and a top view of the stirring member 102, respectively. The area of the stirring member 102 opposing the inside wall of the casing 103 are divided into three by the two ditched portions D.

When the area opposing the inside wall of the casing 103 is divided in such a manner, it is possible to reduce degradation of the ability of stirring particles and prevent local concentration of friction heat caused by the shearing force applied to mother toner particles between the stirring member 102 and the inside wall of the casing 103 even if a large stirring member 102 is used.

The ratio of the superficial area of the area having a ditched portion D to the superficial area of the area opposing the inside wall of the casing 103 is from 15% to 50% and preferably from 20% to 40%.

The casing 103 may employ a spherical form, a conical form, etc. other than a cylindrical form as long as the cross section of the inner periphery relative to the rotation axis of the shaft member 101 is arranged circularly around the rotation direction with a substantially constant distance between the inner periphery of the casing 103 and the rotation axis of the shaft member 101 in a state in which the stirring members 102 are covered.

The peripheral speed of the stirring members 102 when the shaft member 101 is rotated is from 10 m/s to 150 m/s and preferably from 10 m/s to 120 m/s.

In addition, the diameter of the circle path of the stirring member 102 when the shaft member 101 is rotated is from 0.09 m to 1 m and preferably from 0.12 m to 0.75 m.

When mother toner particles {mixed with second particles having a particle diameter of from 10 nm to less than 100 nm} are mixed with first particles having a particle diameter of from 100 nm to 1 micro meter (and the second particles) using the mixer 100, the first particles (and the second particles) are embedded or extended on the surface of the mother toner particles by the force of impact between the stirring member 102 and the mother toner particle and the shearing force applied to the mother toner particles between the inside wall of the casing 103 and the stirring members 102 so that the first particles (and the second particles) are fixed onto the mother toner particle.

The mother toner particle contains a binder resin and a coloring agent.

During this mixing process, the temperature rise of the atmosphere in the casing 103 can be reduced by flowing the cooling medium in the cooling jacket 104.

The temperature of the atmosphere in the casing 103 is preferably from a temperature 50° C. lower than the glass transition temperature of the binder resin to a temperature 15° C. lower than the glass transition temperature thereof.

When the temperature of the atmosphere in the casing 103 is too low, it tends to be difficult to fix the first particles onto the mother toner particle. When the temperature of the atmosphere in the casing 103 is too high, the stirring force of the stirring members 102 is transmitted to the mother toner particle, thereby easily melting the mother toner particles and causing a releasing agent to be exposed.

In addition, by flowing the cooling medium in the flow path 112 formed inside the shaft member 101, it is possible to reduce the occurrence of fusion and attachment of the mother toner particle to the shaft member 101 and the stirring member 102 caused by heat generation accompanied by the rotation of the shaft member 101.

Figure 4:
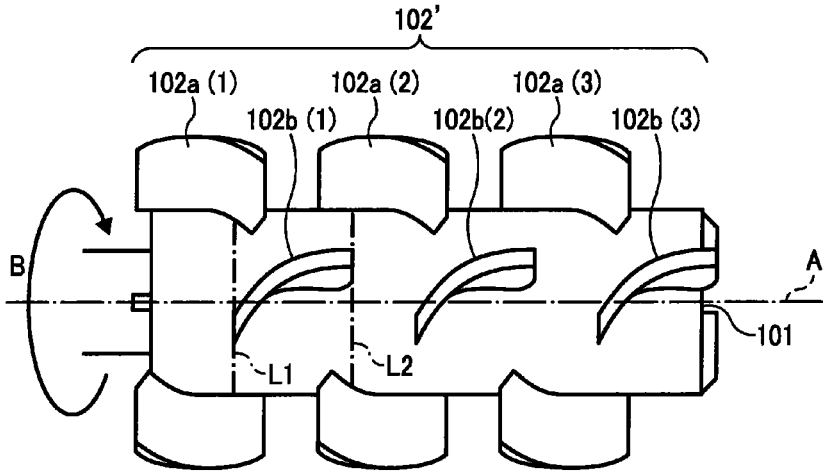
FIG. 4 is a schematic diagram illustrating a variation of the stirring member illustrated in FIG. 1.

FIG. 4 is a diagram illustrating a variation of the stirring member 102. A stirring member 102' has stirring members 102*a* having a stirrup form to transfer particles in the first direction (toward the right direction in FIG. 4) substantially parallel to the rotation direction of the shaft member 101 and stirring members 102*b* having a stirrup form to transfer back particles in the second direction (toward the left direction in FIG. 4) counter to the first direction in which the stirring member 102*a* transfers the particles. That makes the fluidity of the particles active in the casing 103, thereby preventing agglomeration or fusion and attachment of particles between the stirring member 102 and the inner wall of the casing 103. In addition, the transfer route of the particles in the casing 103 becomes complex and long so that the stirring force of the stirring members 102 is more strongly transmitted to the particles.

In addition, the stirring member 102*a* and the stirring member 102*b* are provided to the ends on which the inlet 106 and the outlet 107 of the shaft member 101 are formed. As a result, transfer of the particles to both ends of the shaft member 101 that are not easily affected by the function of the stirring members 102' is prevented so that particles to which the stirring force of the stirring member 102' is not fully transmitted are prevented from being discharged through the outlet 107.

Six of the stirring member 102*a* and six of the stirring member 102*b* are provided to the surface of the shaft member 101.

Three of the stirring members 102*a* and three of the stirring members 102*b* are provided substantially parallel to the rotation axis A of the shaft member 101 and two are provided in the rotation direction of the shaft member 101. In addition, each of the stirring members 102*a* and 102*b* is provided symmetrical with respect to a point.

Three or more of the stirring members 102*a* and three or more of the stirring members 102*b* can be provided and arranged substantially parallel to the rotation axis A of the shaft member 101. When one or two of the stirring members 102*a* and the stirring members 102*b* are provided and arranged parallel to the rotation axis A of the shaft member 101, particles are not easily stirred uniformly, meaning that the particles are not evenly dispersed or the first particles are not uniformly fixed on mother toner particles.

When the stirring members 102*a* and the stirring members 102*b* are adjacent to each other, these are overlapped in a substantially parallel direction relative to the rotation axis A of the shaft member 101 and offset from each other circumferentially in the circumferential (rotation) direction B of the shaft member 101. To be specific, draw a curve L1 and a curve L2 in the rotation direction B of the shaft member 101 from both ends of the stirring member 102*b*(1) to cross the stirring members 102*a*(1) and 102*a*(2) adjacent to the stirring member 102*b*(1), respectively. In addition, the same positional relationship is true for the stirring members 102*a*(1), 102*a*(2), 102*a*(3), 102*b*(2), and 102*b*(3), Consecutively, the particles are moved from the end of the stirring member 102*a* (or 102*b*) to the inner side of the adjacent stirring member 102*b* (or 102*a*) so that the force of stirring by the stirring members 102*a* and 102*b* is strongly transmitted to the particles.

There is no specific limit to the form of the stirring members 102*a* and 102*b* and the stirring members 102*a* and 102*b* may have a board form, a ditch form, a paddle form, etc. other than the stirrup form.

First embodiment of the method of manufacturing the toner of the present disclosure includes a step of mixing mother toner particles having a binder resin and a coloring agent and the first particle having an average primary particle diameter of from 100 nm to 1 μm using the mixer 100.

The weight ratio of the first particle to the mother toner particle is from 1.5% to 10%, preferably from 2% to 8%, and more preferably from 3% to 6%. When the weight ratio of the first particle to the mother toner particle is too small, it tends to be difficult to fix a certain amount or more of the first particle onto the surface of the mother toner particle.

In such a case, when second particles having an average primary particle diameter of from 10 nm to less than 100 nm are fixed onto the surface of the mother toner particles, it is difficult to prevent embedding of the second particle existing on the surface of the mother toner particle if image formations are conducted over a long period of time.

To the contrary, when the weight ratio of the first particle to the mother toner particle is too large, it is difficult to prevent detachment of the first particle existing on the surface of the mother toner particle if image formations are conducted over a long period of time.

The average primary particle diameter of the first particle is from 100 nm to 1 μm, preferably from 200 nm to 900 nm, and more preferably from 300 nm to 800 nm. When the first particles having an excessively small average primary particle diameter are fixed onto the surface of mother toner particles, it is difficult to prevent embedding of the second particle if image formations are conducted over along-period of time. The first particles having an excessively large average primary particle diameter are not easily fixed onto the surface of mother toner particles.

The average primary particle diameter of the second particle is from 10 nm to less than 100 nm, preferably from 20 nm to 90 nm, and more preferably from 30 nm to 80 nm. The second particles having an excessively small average primary particle diameter are not easily fixed onto the surface of mother toner particles. When the second particles have an excessively large average primary particle diameter, the fluidity of the toner tends to deteriorate.

Second embodiment of the method of manufacturing the toner of the present disclosure includes a step of mixing mother toner particles having a binder resin and a coloring agent, the first particle having an average primary particle diameter of from 100 nm to 1 μm, and the second particle having an average primary particle diameter of from 10 nm to less than 100 nm using the mixer 100.

The weight ratio of the first particle to the mother toner particle is from 1.5% to 10%, preferably from 2% to 8%, and more preferably from 3% to 6%. When the weight ratio of the first particle to the mother toner particle is too small, the amount of the first particles fixed onto the surface of mother toner particles tends to be too small so that it is difficult to prevent embedding of the second particle existing on the surface of the mother toner particle if image formations are conducted over a long period of time. To the contrary, when the weight ratio of the first particle to the mother toner particle is too large, it tends to be difficult to prevent detachment of the first particle existing on the surface of the mother toner particle if image formations are conducted over a long period of time.

The weight ratio of the second particle to the mother toner particle is preferably from 0.1% to 5%, more preferably from 0.5% to 4%, and particularly preferably from 1% to 3%. When the weight ratio of the second particle to the mother toner particle is too small, the fluidity of the toner tends to deteriorate. The second particles having an excessively large average primary particle diameter are not easily fixed onto the surface of mother toner particles.

The average primary particle diameter of the first particle is from 100 nm to 1 μm, preferably from 200 nm to 900 nm, and more preferably from 300 nm to 800 nm. When the first particle having an excessively small average primary particle diameter is too small, it is difficult to prevent embedding of the second particle if image formations are conducted over a long period of time. The first particles having an excessively large average primary particle diameter are not easily fixed onto the surface of mother toner particles.

The average primary particle diameter of the second particle is from 10 nm to less than 100 nm, preferably from 20 nm to 90 nm, and more preferably from 30 nm to 80 nm. Second particles having an excessively small average primary particle diameter are not easily fixed onto the surface of mother toner particles. When the second particles have an excessively large average primary particle diameter, the fluidity of the toner tends to deteriorate.

Third embodiment of the method of manufacturing the toner of the present disclosure includes a step of mixing the mother toner particle and the second particle to obtain a mixture of the mother toner particle and the second particle and a step of mixing the mixture of the mother toner particle and the second particle and the first particle using the mixer 100.

There is no specific limitation to the selection of the mixer used to mix the mother toner particle and the second particle. It is possible to suitably use any mixer having a mixing tank containing a processing room as long as it has a rotary shaft member that substantially vertically pierces the base of the mixing tank and a stirring wing provided to the rotary shaft member in the processing room. Specific examples thereof include, but are not limited to, FM mixers (Henschel mixers), Super mixers, and Mechanohybrid (Q type) mixers.

Other mixers described later can be also used.

Fourth embodiment of the method of manufacturing the toner of the present disclosure includes a step of mixing the mother toner particle and the first particle using the mixer 100 to obtain a mixture of the mother toner particle and the first particle and a step of mixing the mixture of the mother toner particle and the first particle and the second particle.

There is no specific limitation to the selection of the mixer used to mix the mixture of the mother toner particle and the first particle and the second particle. It is possible to suitably use any mixer having a mixing tank containing a processing room as long as it has a rotary shaft member that substantially vertically pierces the base of the mixing tank and a stirring wing provided to the rotary shaft member in the processing room. Specific examples thereof include, but are not limited to, FM mixers (Henschel mixers), Super mixers, and Mechanohybrid (Q type) mixers. Other mixers described later can be also used.

Fourth embodiment of the method of manufacturing the toner of the present disclosure further includes a step of mixing the mixture of the mother-toner particle, the first particle, and the second particle and the first particle using the mixer 100 or a step of mixing the mixture of the mother toner particle, the first particle, and the second particle and the second particle.

There is no specific limitation to the selection of the mixer used to mix the mixture of the mother toner particle, the first particle, and the second particle and the second particle. It is possible to suitably use any mixer having a mixing tank containing a processing room as long as it has a rotary shaft member that substantially vertically pierces the base of the mixing tank and a stirring wing provided to the rotary shaft member in the processing room. Specific examples thereof include, but are not limited to, FM mixers (Henschel mixers), Super Mixers, and Mechanohybrid (Q type) mixers. Other mixers described later can be also used.

There is no specific limit to the selection of materials constituting the first particle. Specific examples thereof include, but are not limited to, resins such as styrene-acrylic copolymers and polyester; and inorganic compounds such as silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Specific examples of the styrene-acrylic copolymers include, but are not limited to, copolymers of styrene and (meth)acrylic-based monomer such as acrylic acid, an alkyl ester (having 1 to 36 carbon atoms) of acrylic acid, methacrylic acid, an alkyl ester (having 1 to 36 carbon atoms) of methacrylic acid, ethylene glycol dimethacrylate, and perfluoroalkyl of acrylic acid.

The weight ratio of the (meth)acrylic-based monomer to the styrene constituting the styrene-acrylic copolymers is from 95/5 to 5/95 and preferably from 90/10 to 10/90.

The first particle composed of the styrene-acrylic copolymers is obtained by, for example, copolymerization of styrene and (meth(acrylic-based) monomer under the presence of a polymerization initiator.

The softening point of the resin constituting the first particle is preferably 150° C. or higher in terms of fusion and attachment thereof to an image bearing member, etc.

The glass transition temperature of the resin constituting the first particle is preferably 60° C. or higher in terms of aggregation.

The first particle formed by resins is preferably surface-treated by p-toluene sulfonic acid or a salt thereof in light of electric resistance.

Specific examples of the salts of p-toluene sulfonic acid include, but are not limited to, alkali metal salts such as sodium salts and potassium salts; ammonium salts such as tetramethyl ammonium salts; pyridinium salts such as hexadecyl pyridinium salts; and imidazolinium salts such as 1,1-dimethyl-2-hexadecyl imidazolinium. Among these, in terms of affinity with the first particle composed of resins, alkali metal salts are preferable and sodium salts are particularly preferable.

The amount of surface treatment by p-toluene sulfonic acid or a salt thereof is from 0.1 to 5% by weight and preferably from 0.5 to 3% by weight based on the first particle composed of resins.

There is no specific limit to the selection of methods of conducting surface treatment with p-toluene sulfonic acid and a salt thereof. For example, the first particle is surface-treated by a method of mixing an aqueous solution of p-toluene sulfonic acid or a salt thereof with the first particle composed of resins followed by drying.

There is no specific limit to the selection of materials constituting the second particle. Specific examples thereof include, but are not limited to, the above-specified resins such as styrene-acrylic copolymers and polyester; and the above-specified inorganic compounds such as silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these, considering the fluidity of toner, inorganic compounds are preferable.

Specific examples of the resins contained in the mother toner particle include, but are not limited to, styrene polymers and single polymers of substituted styrene monomers such as polystyrene, poly-p-chlorostyrene, and polyvinyltoluene; styrene copolymers such as styrene-p-chlorostyrene copolymers, styrene-vinyltoluene copolymers, styrene-vinylnaphthalene copolymers, styrene acrylic acid ester copolymers, styrene methacrylic acid ester copolymers, styrene-α-methyl chloromethacrylate copolymers, styrene-acrylonitrile copolymers, styrene-vinyl methyl ether copolymers, styrene-vinyl ethyl ether copolymers, styrene vinyl methyl ketone copolymers, styrene-butadiene copolymers, styrene-isoprene copolymers, and styrene-acrylonitrile-indene copolymers; polyvinyl chloride; phenolic resins; natural modified phenolic resins; natural modified maleic acid resins; acrylic acid resins; methacrylic acid resins; polyvinyl acetate; silicone resins; polyesters; polyurethanes; polyamides; furan resins; epoxy resins; xylene resins; polyvinyl butyral; terpene-resins; coumarone-indene resin; and petroleum resins. These resins can be used alone or in combination. Among these, styrene copolymers or polyesters are preferable.

Specific examples of the coloring agents contained in the mother toner particle include, but are not limited to, yellow pigments, magenta pigments, and cyan pigments.

There is no specific limitation to the selection of the yellow pigments. Specific examples thereof include, but are not limited to, condensed azo compounds, isoindolinone compounds, anthraquinone compounds, azo metal complexes, methine compounds, and aryl amide compounds. These can be used alone or in combination.

Specific examples of the yellow pigments available in the martet include, but are not limited to, C.I, Pigment Yellow 3, 12, 13, 14, 15, 17, 62, 65, 73, 74, 83, 90, 93, 95, 96, 97, 109, 110, 111, 120, 128, 129, 138, 147, 155, 168, 180, and 181; Naphthol Yellow S, Hanza Yellow G, and C.I. Vat Yellow.

There is no specific limitation to the selection of the magenta pigments. Specific examples thereof include, but are not limited to, condensed azo compounds, diketopyrrolopyrrol compounds, anthraquinone compounds, quinacridone compounds, basic dye lake compounds, naphtol compounds, benz imidazolone compounds, thioindigo compounds, and perylene compounds. These can be used alone or in combination.

Specific examples of the magenta pigments available in the market include, but are not limited to, C.I. Pigment Red 2, 3, 5, 6, 7, 23, 48, 48:2, 48:3, 48:4, 57, 57:1, 58, 60, 63, 64, 68, 81, 81:1, 83, 87, 88, 89, 90, 112, 114, 122, 123, 144, 146, 149, 163, 166, 169, 170, 177, 184, 185, 187, 202, 206, 207, 209, 220, 251, and 254, and C.I. Pigment Violet 19.

There is no specific limitation to the selection of the cyan pigments. Specific examples thereof include, but are not limited to, copper phthalocyanine compounds, derivatives thereof, anthraquinone compounds, and basic dye lake compounds. These can be used alone or in combination.

Specific examples of the cyan pigments available in the market include, but are not limited to, C.I. Pigment Blue 1, 2, 3, 6, 7, 15, 15:1, 15:2, 15:3, 15:4, 16, 17, 60, 62, and 66, phthalocyanine Blue, C.I. Vat Blue, and C.I. Acid Blue.

The content of the coloring agent is preferably from 2 to 20% by weight and more preferably from 4 to 15% by weight based on the binder resin. When the content of the coloring agent is too small based on the binder resin, the coloring ability tends to be insufficient. When the content of the coloring agent is too small based on the binder resin, the coloring ability tends to increase unnecessarily, which makes it difficult to reproduce pale colors, etc.

The mother toner particles may contain a releasing agent and a charge control agent.

There is no specific limit to the selection of the releasing agent. Specific examples thereof include, but are not limited to, waxes having a carbonyl group, polyolefin waxes, and a long-chain hydrocarbon. These can be used alone or in combination. Among these, the wax including a carbonyl group is preferable.

Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkane acid amides such as dibehenyl amide; polyalkylamide such as trimellitic acid tristearylamide; dialkyl ketones such as distearyl ketone, etc. Among these waxes, polyalkane acid esters are preferable.

Specific examples of the polyolefin waxes include, but are not limited to, polyethylene waxes and polypropylene waxes.

Specific examples of the long-chain hydrocarbons include, but are not limited to, paraffin wax and sazol wax.

The melting point of the releasing agent is from 40° C. to 160° C., more preferably from 50° C. to 120° C., and particularly preferably from 60° C. to 90° C. When the melting point of the releasing agent is too low, the high temperature storage of the toner may deteriorate. When the glass transition temperature is too high, the low temperature fixing property may deteriorate.

The content of the releasing agent in the mother toner particle is from 3% to 15% based on 100 of the binder resin.

There is no specific limit to the selection of the charge control agents. Specific examples thereof include, but are not limited to, nigrosine dyes, triphenylmethane dyes, chrome containing metal complex dyes, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surface active agents, metal salts of salicylic acid and derivatives thereof, copper phthalocyanine, perylene, quinacridone, azo-based pigments, and polymer compounds having a functional group such as a sulfonate group, a carboxyl group, or a quaternary ammonium basic group. These can be used alone or in combination.

Specific examples of the marketed products of the charge control agents include, but are not limited to, BONTRON 03 (nigrosine dye), BONTRON P-51 (quaternary ammonium salt), BONTRON S-34 (azo dyes containing metal), E-82 (metal complex of oxynaphthoic acid), E-84 (metal complex of salicylic acid), and E-89 (phenolic condensation product), all of which are manufactured by Orient Chemical Industries Co., Ltd.; TP-302 and TP-415 (molybdenum complex of quaternary ammonium salts), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 (quaternary ammonium salt), and COPY CHARGE NX VP434, all of which are manufactured by Hoechst AG; and LRA-901 and LR-147 (boron complex), which are manufactured by Japan Carlit Co., Ltd.

The glass transition temperature of the mother toner particle is preferably from 40° C. to 65° C. When the glass transition temperature is too low, the storage stability of the toner may deteriorate. When the glass transition temperature is too high, the low temperature fixing property may deteriorate.

The glass transition temperature of the mother toner particle can be measured by TA-60WS or DSC-60 (manufactured by Shimadzu Corporation).

The mother toner particle preferably has a volume average particle diameter of from 3 μm to 9 μm. When the volume average particle diameter of the mother toner particle is too small, the fusion and attachment of the toner tends to occur. When the volume average particle diameter of the mother toner particle is too large, quality images are not easily obtained.

The volume average particle diameter of the mother toner particle can be measured by Coulter Counter Multisizer II (manufactured by Beckman Coulter Inc.).

The average circularity of the mother toner particle is from 0.90 to 1.0, preferably from 0.92 to 1.0, and more preferably from 0.94 to 1.0. When the average circularity of the mother toner particle is too small, the first particle and the second particle are not easily fixed on the mother toner particle uniformly.

The average circularity of the mother toner particle can be measured by a flow type particle image analyzer (FPIA-2000, manufactured by SYSMEX CORPORATION).

There is no specific limit to the method of manufacturing the mother toner particle. Specific examples thereof include, but are not limited to, pulverization methods and polymerization methods.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but not limited thereto.

Manufacturing of Mother Toner Particle 1

After mixing 100 parts of polyester having a half efflux starting temperature of 126° C., 3 parts of quaternary ammonium salt containing fluorine, and 3 parts of copper phthalocyanine C.I. Pigment Blue 15:3 (manufactured by Dainichiseika Color and Chemicals Mfg. Co., Ltd.) by a blender, two rolls heated to 100° C. to 110° C. are used to melt, mix and knead the mixture followed by natural cooling down. Next, the resultant is coarsely pulverized by a cutter mill and thereafter finely pulverized by a fine pulverizer using jet air. Furthermore, the pulverized material is classified by an air classifier to obtain a mother toner particle 1.

The mother toner particle 1 has a glass transition temperature of 60° C. and a volume average particle diameter of 7.4 μm.

Manufacturing of Mother Toner Particle 2

An acid monomer formed of 98 mol % dimethyl sebacate and 2 mol % dimethyl sodium 5-sulfoisophthalate and an alcohol monomer consisting of ethylene glycol are placed in a heated and dried flask with a mol ratio of 1 to 1. Subsequent to placing 0.3 weight % dibutyl tin oxide in the flask to the total monomer, the air in the flask is substituted with nitrogen followed by a five hour reflux at 180° C. Next, subsequent to raising the temperature of the system to 230° C. with a reduced pressure followed by a two hour stirring, the resultant is cooled down when it has become tenacious to terminate the reaction to obtain a crystalline polyester.

The weight average molecular weight (in polystyrene conversion) of the crystalline polyester measured by gel permeation chromatography is 9,700. The crystalline polyester has a melting point of 72° C., 90 parts of the thus-obtained crystalline polyester, 1.8 parts of cationic surface active agent NEOGEN RK (manufactured by DAI-ICHI KOGYO SEIYAKU CO., LTD.), and 210 parts of deionized water are heated to 100° C. and dispersed by a homogenizer (Ultratarax T50, manufactured by IKA Co., Ltd.). Thereafter, a pressure discharging type gaulin homogenizer is used to conduct a one hour dispersion to obtain a crystalline polyester liquid dispersion having a volume average particle diameter of 200 nm and a solid portion of 20% by weight.

30 mol % terephthalic acid, 70 mol % fumaric acid, 20 mol % adduct of bisphenol A with 2 mol of ethylene oxide, and 80 mol % adduct of bisphenol A with 2 mol of propylene oxide are placed in a flask equipped with a stirrer, a nitrogen introducing tube, a temperature sensor, and a rectifying column and heated to 190° C. in one hour.

Next, 1.2 parts of 1.2% by weight dibutyl tin oxide is added to all the monomers. Furthermore, while distilling away the water produced, the system is heated to 240° C. in six hours and kept for three hours to obtain a non-crystalline polyester.

The thus-obtained non-crystalline polyester has an acid value of 12.0 mg/KOH, a weight average molecular weight of 9,700, and a glass transition temperature of 61° C.

While the thus obtained melted non-crystalline polyester is transferred to CAVITRON CD1010 (manufactured by Eurotech Co., Ltd.) at 100 g/minute, 0.37 weight % diluted ammonia water is transferred to CAVITRON CD1010 at 0.1

L/minute while heating the diluted ammonium by a heat exchanger to 120° C. Furthermore, the CAVITRON is operated while the rotor is rotated at 60 Hz with a pressure of 5 kg/cm$^2$ to obtain a non-crystalline polyester liquid dispersion having a volume average particle diameter of 0.16 μm and a solid portion of 30% by weight.

45 parts of phthalocyanine C.I. Pigment Blue 15:3 (manufactured by Dainichiseika Color and Chemicals Mfg. Co., Ltd.), 5 parts of cationic surface active agent NEOGEN RK (manufactured by DAI-ICHI KOGYO SEIYAKU CO., LTD.), and 200 parts of deionized water are mixed followed by dispersion using a homogenizer (Ultratarax T50, manufactured by IKA Co., Ltd.) to obtain a coloring agent liquid dispersion having a volume average particle diameter of 168 nm and a solid portion of 22% by weight.

45 parts of paraffin wax (HNP9, manufactured by Nippon Seiro Co., Ltd.) having a melting point of 75° C., 5 parts of a cationic surface active agent (NEOGEN RK, manufactured by DAI-ICHI KOGYO SEIYAKU CO., LTD.), and 200 parts of deionized water are mixed and heated to 95° C.

The mixture is dispersed by a homogenizer (Ultratarax T50, manufactured by IKA Co., Ltd.). Thereafter, a pressure discharging type gaulin homogenizer is used for dispersion to obtain a releasing agent liquid dispersion having a volume average particle diameter of 200 nm and a solid portion of 20% by weight.

256.7 parts of the non-crystalline polyester liquid dispersion, 33.3 parts of the crystalline polyester liquid dispersion, 27.3 parts of the coloring agent liquid dispersion, and 35 parts of the releasing agent liquid dispersion are placed in a stainless flask and dispersed by a homogenizer (Ultratarax T50, manufactured by IKA Co., Ltd.).

Next, 0.20 parts of polyaluminum chloride is added to the flask followed by dispersion using a homogenizer (Ultratarax T50, manufactured by IKA Co., Ltd.). The system is heated to 48° C. and kept for 60 minutes. Furthermore, 70 parts of the non-crystalline polyester liquid dispersion is added to the flask. Thereafter, 0.5 mol/L sodium hydroxide aqueous solution is used to make the system to have a pH of 9.0. Next, the stainless flask is sealed and heated to 96° C. and held for five hours followed by cooling-down. Furthermore, the liquid is filtered and the obtained residual is washed with deionized water. Thereafter, the solid portion is separated from the liquid by a Nutsche type suction filter. Next, the residual is added to one-litter of deionized water at 40° C. followed by stirring at 300 rpm for 15 minutes using a homogenizer (Ultratarax T50, manufactured by IKA Co., Ltd.) and filtration repeatedly. When the pH of the filtrate has become 7.5 and the electric conductivity thereof has become 7.0 μS/cm, the filtrate is subjected to Nutsche type suction filtration using paper filter No. 5A to conduct solid-liquid separation.

Furthermore, the resultant is vacuum-dried for 12 hours to obtain mother toner particle 2. The mother toner particle 2 has a glass transition temperature of 56° C. and a volume average particle diameter of 5.9 μm.

Glass Transition Temperature of Mother Toner Particle

In addition, the glass transition temperature is measured under the following measuring conditions by using TA-60WS and DSC-60, manufactured by Shimadzu Corporation.

Sample container: Aluminum sample pan (with a lid)
Sample amount: 5 mg
Reference: Aluminum sample pan (alumina 10 mg)
Atmosphere: nitrogen (flow amount: 50 ml/min)
(Temperature Rise Condition 1)
Starting Temperature: 20° C.
Heating speed: 10° C./min
Ending temperature: 150° C.
Holding time: None
(Cooling Down Condition)
Cooling down speed: −10° C./min
Ending temperature: 20° C.
Holding time: None
(Temperature Rise Condition 2)
Heating speed: 10° C./min
Ending temperature: 150° C.

The measuring results are analyzed by using data analysis software (TA-60, version 1.52, manufactured by Shimadzu Corporation). To be specific, by assigning a range of from +5° C. to −5° C. relative to the maximum peak on the lowest temperature side of DrDSC curve representing the DSC differential curve in the second temperature rise as the + or −5° C. range, the peak temperature is obtained using a peak analysis function of the analysis software.

Next, in the range of from +5° C. to −5° C. relative to the peak temperature of the DSC curve, the maximum endothermic peak of the DSC curve using the peak analysis function of the analysis software.

Volume Average Particle Diameter of Mother Toner Particle

The volume average particle diameter of the mother toner particle can be measured by Coulter Counter Multisizer II (manufactured by Beckman Coulter Inc.). To be specific, 0.1 to 5 ml of polyoxyethylene alkyl ether is added to 100 to 150 ml of about 1% by weight sodium chloride aqueous solution ISOTON-II (manufactured by Beckman Coulter Inc.). Next, 2 to 20 mg of the mother toner particle is added to the liquid followed by dispersion by an ultrasonic disperser for about one to about three minutes.

Furthermore, the volume average particle diameter of the mother toner particle is obtained using an aperture of 100 μm×100 μm. The whole range is a particle diameter of from 2.00 μm to not greater than 40.30 μm and the number of the channels is 13. Channels are: from 2.00 μm to not greater than 2.52 μm; from 2.52 μm to not greater than 3.17 μm; from 3.17 μm to not greater than 4.00 μm; from 4.00 μm to not greater than 5.04 μm; from 5.04 μm to not greater than 6.35 μm; from 6.35 μm to not greater than 8.00 μm; from 8.00 μm to not greater than 10.08 μm; from 10.08 μm to not greater than 12.70 μm; from 12.70 μm to not greater than 16.00 μm, from 16.00 μm to not greater than 20.20 μm; from 20.20 μm to not greater than 25.40 μm; from 25.40 μm to not greater than 32.00 μm; and from 32.00 μm to not greater than 40.30 μm.

Manufacturing of Resin Particle Having Negative Charging Property 1,200 parts of deionized water is placed in a flask equipped with a nitrogen introducing tube, a reflux tube, and a dripping funnel. Subsequent to heating the system to 80° C., 25.5 parts of styrene, 3 parts of 2-ethyl hexyl acrylate, 1.5 parts of methacrylic acid, and 3 parts of ammonium persulfate dissolved in 15 parts of deionized water are added to the flask and held for 10 minutes.

Next, 229.5 parts of styrene, 27 parts of methyl methacrylate, and 13.5 parts of ethylene glycol dimethacrylate are dripped to the flask in 90 minutes. Thereafter, 27 parts of styrene and 3 parts of methyl methacrylate are dripped thereto in 10 minutes and the system is held at 80° C. for 60 minutes. Furthermore, the resultant is filtered by an ultrafilter. After the residual is washed, 3 parts of p-toluene sodium sulfonate dissolved in 15 parts of deionized water are added to 100 parts of resin particles having a negative charging property followed by stirring.

Then after the resultant is dried by a spray dryer, the dried product is pulverized by a jet mill to obtain resin particles having a negative charging property. The resin particle having a negative charging property has a softening point of 204° C., a glass transition temperature of 97° C., and an average primary particle diameter of 500 nm.

Example 1

2,000 g of the mother toner particle 1 and 100 g of the resin particle having a negative charging property are placed in and mixed by a NOBILTA NOB-300 type (manufactured by Hosokawa Micron Group) serving as the mixer 100 to obtain toner. The diameter of the circle path of the stirring member 102 when the shaft member 101 is rotated is 0.3 m with a clearance C of 3 mm. In addition, while the peripheral speed of the stirring member 102 is adjusted in the range of from 10 m/s to 150 m/s such that the power of the stirring member 102 to 1 kg of the particle is 6.0 kW, mixing is conducted until the energy is 0.5 kWh.

Furthermore, the system is cooled down such that the temperature of the atmosphere in the casing 103 ranges from 15° C. to 35° C.

The power of the stirring member 102 to the particle represents the difference between the electricity (or electric energy) of a power motor to rotate the shaft member 101 without placing the particle in the casing 103 and the electricity (or electric energy) of the power motor to rotate the shaft member 101 with the particle placed in the casing 103 while no other conditions are different.

Example 2

The toner of Example 2 is obtained in the same manner as in Example 1 except that 2,000 g of the mother toner particle 1, 100 g of the resin-particle having a negative charging property, and 40 g of silica particle RX50 (manufactured by Nippon Aerosil Co., Ltd.) having an average primary particle diameter of 40 nm) are mixed by a NOBILTA NOB-300 (manufactured by Hosokawa Micron Group).

Example 3

2,000 g of the mother toner particle 1 and 100 g of the resin particle having a negative charging property are placed in and mixed by a NOBILTA NOB-300 type (manufactured by Hosokawa Micron Group) in the same manner as in Example 1.

Next, 40 g of silica particle RX50 (manufactured by Nippon Aerosil Co., Ltd.) having an average primary particle diameter of 40 nm) are placed in and mixed by the NOBILTA NOB-300 (manufactured by Hosokawa Micron Group) to obtain toner of Example 3. In addition, this mixing is conducted in the same manner as in Example 1 except that while the peripheral speed of the stirring member 102 is adjusted in the range of from 10 m/s to 150 m/s such that the power of the stirring member 102 to 1 kg of the particle is 0.6 kW, mixing is conducted until the energy is 0.05 kWh.

Example 4

The toner of Example 4 is obtained in the same manner as in Example 1 except that 2,000 g of the mother toner particle 1, 100 g of the resin particle having a negative charging property, and 40 g of silica particle RX50 (manufactured by Nippon Aerosil Co., Ltd.) having an average primary particle diameter of 40 nm) are mixed by a NOBILTA NOB-300 (manufactured by Hosokawa Micron Group).

Next, 40 g of silica particle RX50 (manufactured by Nippon Aerosil Co., Ltd.) having an average primary particle diameter of 40 nm are placed in and mixed by the NOBILTA NOB-300 (manufactured by Hosokawa Micron Group) to obtain toner of Example 4. In addition, this mixing is conducted in the same manner as in Example 1 except that while the peripheral speed of the stirring member 102 is adjusted in the range of from 10 m/s to 150 m/s such that the power of the stirring member 102 to 1 kg of the particle is 0.6 kW, mixing is conducted until the energy is 0.05 kWh.

Example 5

2,000 g of the mother toner particle 1 and 100 g of the resin particle having a negative charging property are placed in and mixed by a NOBILTA NOB-300 (manufactured by Hosokawa Micron Group) in the same manner as in Example 1 to obtain a mixture.

Next, the mixture and 40 g of silica particle RX50 (manufactured by Nippon Aerosil Co., Ltd.) having an average primary particle diameter of 40 nm are placed in a Henschel Mixer FM20B (manufactured by NIPPON COKE & ENGINEERING CO., LTD.) and mixed thereby at a peripheral speed of 30 m/s for five minutes to obtain toner of Example 5.

Example 6

2,000 g of the mother toner particle 1 and 40 g of silica particle RX50 (manufactured by Nippon Aerosil Co., Ltd.) having an average primary particle diameter of 40 nm are placed in a Henschel Mixer FM20B (manufactured by NIPPON COKE & ENGINEERING CO., LTD.) and mixed thereby at a peripheral speed of 30 m/s for five minutes to obtain a mixture.

Next, the mixture and 100 g of the resin particle having a negative charging property are placed in a NOBILTA NOB-300 (manufactured by Hosokawa Micron Group) and mixed thereby in the same manner as in Example 1.

Example 7

Toner of Example 7 is obtained in the same manner as in Example 5 except that colloidal silica CAB-O-SIL TG-C190 (manufactured by Cabot Specialty Chemicals Inc.) having its surface treated with octadecyl triethoxysilane (OTES) having an average primary particle diameter of 115 nm is used instead of the resin particle having a negative charging property.

Example 8

Toner of Example 8 is obtained in the same manner as in Example 5 except that anatase type titanium oxide particle TA-300 (manufactured by Fuji Titanium Industry Co., Ltd.) having an average primary particle diameter of 450 nm is used instead of the resin particle having a negative charging property.

Example 9

Toner of Example 9 is obtained in the same manner as in Example 5 except that alumina particle TM-5D (manufactured by TAIMEI CHEMICALS Co., Ltd.) having an average primary particle diameter of 200 nm is used instead of the resin particle having a negative charging property.

Example 10

Toner of Example 10 is manufactured in the same manner as in Example 5 except that the added amount of the resin particle having a negative charging property is changed to 184 g.

Example 11

Toner of Example 11 is manufactured in the same manner as in Example 4 except that the mother toner particle 2 is used instead of the mother toner particle 1.

Comparative Example 1

2,000 g of the mother toner particle 1 and 40 g of silica particle RX50 (manufactured by Nippon Aerosil Co., Ltd.) having an average primary particle diameter of 40 nm are placed in and mixed by the NOBILTA NOB-300 (manufactured by Hosokawa Micron Group) to obtain toner of Comparative Example 1. This mixing is conducted in the same manner as in Example 1 except that while the peripheral speed of the stirring member 102 is adjusted in the range of from 10 m/s to 150 m/s such that the power of the stirring member 102 to 1 kg of the particle is 0.6 kW, mixing is conducted until the energy is 0.05 kW.

Comparative Example 2

2,000 g of the mother toner particle 1 and 40 g of silica particle RX50 (manufactured by Nippon Aerosil Co., Ltd.) having an average primary particle diameter of 40 nm are placed in a Henschel Mixer FM20B (manufactured by NIPPON COKE & ENGINEERING CO., LTD.) and mixed thereby at a peripheral speed of 30 m/s for five minutes to obtain toner of Comparative Example 2.

Comparative Example 3

2,000 g of the mother toner particle 1 and 100 g of the resin particle having a negative charging property are placed in a Henschel Mixer FM20B (manufactured by NIPPON COKE & ENGINEERING CO., LTD.) and mixed thereby at a peripheral speed of 45 m/s for five minutes to obtain toner of Comparative Example 3.

Comparative Example 4

2,000 g of the mother toner particle 1 and 100 g of the resin particle having a negative charging property are placed in a Henschel Mixer FM20B (manufactured by NIPPON COKE & ENGINEERING CO., LTD.) and mixed thereby at a peripheral speed of 45 m/s for five minutes.

Next, 40 g of silica particle RX50 (manufactured by Nippon Aerosil Co., Ltd.) having an average primary particle diameter of 40 nm are added to the Henschel Mixer FM20B (manufactured by NIPPON COKE & ENGINEERING CO., LTD.) and mixed thereby at a peripheral speed of 30 m/s for five minutes to obtain toner of Comparative Example 4.

Comparative Example 5

2,000 g of the mother toner particle 1 and 40 g of silica particle RX50 (manufactured by Nippon Aerosil Co., Ltd.) having an average primary particle diameter of 40 nm are placed in a Henschel Mixer FM20B (manufactured by NIPPON COKE & ENGINEERING CO., LTD.) and mixed thereby at a peripheral speed of 30 m/s for five minutes.

Next, 100 g of the resin particle having a negative charging property are added to the Henschel Mixer FM20B (manufactured by NIPPON COKE & ENGINEERING CO., LTD.) and mixed thereby at a peripheral speed of 45 m/s for five minutes to obtain toner of Comparative Example 5.

Comparative Example 6

2,000 g of the mother toner particle 1, 100 g of the resin particle having a negative charging property, and 40 g of silica particle RX50 (manufactured by Nippon Aerosil Co., Ltd.) having an average primary particle diameter of 40 nm are placed in a Henschel Mixer FM20B (manufactured by NIPPON COKE & ENGINEERING CO., LTD.) and mixed thereby at a peripheral speed of 45 m/s for five minutes.

Next, 100 g of the resin particle having a negative charging property are added to the Henschel Mixer FM20B (manufactured by NIPPON COKE & ENGINEERING CO., LTD.) and mixed thereby at a peripheral speed of 45 m/s for five minutes to obtain toner of Comparative Example 6.

Comparative Example 7

Toner of Comparative Example 7 is obtained in the same manner as in Example 5 except that the added amount of the resin particle having a negative charging property is changed to 14 g.

Comparative Example 8

Toner of Comparative Example 8 is obtained in the same manner as in Example 5 except that the added amount of the resin particle having a negative charging property is changed to 220 g.

Table 1 shows the manufacturing conditions of the toners.

TABLE 1

| | | First Mixing | | | | | | |
|---|---|---|---|---|---|---|---|---|
| | | | Particle | | | Particle | | |
| | Mother toner particle | Mixer | Kind | Average primary particle diameter (nm) | Weight ratio to mother toner particle (%) | Kind | Average primary particle diameter (nm) | Weight ratio to mother toner particle (%) |
| EX. 1 | 1 | NOBILTA | Resin | 500 | 5.0 | — | — | — |
| EX. 2 | 1 | NOBILTA | Resin | 500 | 5.0 | Silica | 40 | 2.0 |
| EX. 3 | 1 | NOBILTA | Resin | 500 | 5.0 | — | — | — |
| EX. 4 | 1 | NOBILTA | Resin | 500 | 5.0 | Silica | 40 | 2.0 |
| EX. 5 | 1 | NOBILTA | Resin | 500 | 5.0 | — | — | — |
| EX. 6 | 1 | HENSCHEL | Silica | 40 | 2.0 | — | — | — |
| EX. 7 | 1 | NOBILTA | Silica | 115 | 5.0 | — | — | — |
| EX. 8 | 1 | NOBILTA | Titanium oxide | 450 | 5.0 | — | — | — |

TABLE 1-continued

| | | | | | | | | |
|---|---|---|---|---|---|---|---|---|
| EX. 9 | 1 | NOBILTA | Alumina | 200 | 5.0 | — | — | — |
| EX. 10 | 1 | NOBILTA | Resin | 500 | 9.2 | — | — | — |
| EX. 11 | 2 | NOBILTA | Resin | 500 | 5.0 | Silica | 40 | 2.0 |
| Comp. 1 | 1 | NOBILTA | Silica | 40 | 2.0 | — | — | — |
| Comp. 2 | 1 | HENSCHEL | Silica | 40 | 2.0 | — | — | — |
| Comp. 3 | 1 | HENSCHEL | Resin | 500 | 5.0 | — | — | — |
| Comp. 4 | 1 | HENSCHEL | Resin | 500 | 5.0 | — | — | — |
| Comp. 5 | 1 | HENSCHEL | Silica | 40 | 2.0 | — | — | — |
| Comp. 6 | 1 | HENSCHEL | Silica | 40 | 2.0 | Resin | 500 | 5.0 |
| Comp. 7 | 1 | NOBILTA | Resin | 500 | 0.7 | — | — | — |
| Comp. 8 | 1 | NOBILTA | Resin | 500 | 11.0 | — | — | — |

| | Second mixing | | | |
|---|---|---|---|---|
| | | Particle | | |
| | Mixer | Kind | Average primary particle diameter (nm) | Weight ratio to mother toner particle (%) |
| EX. 1 | — | — | — | — |
| EX. 2 | — | — | — | — |
| EX. 3 | NOBILTA | Silica | 40 | 2.0 |
| EX. 4 | NOBILTA | Silica | 40 | 2.0 |
| EX. 5 | HENSCHEL | Silica | 40 | 2.0 |
| EX. 6 | NOBILTA | Resin | 500 | 5.0 |
| EX. 7 | HENSCHEL | Silica | 40 | 2.0 |
| EX. 8 | HENSCHEL | Silica | 40 | 2.0 |
| EX. 9 | HENSCHEL | Silica | 40 | 2.0 |
| EX. 10 | HENSCHEL | Silica | 40 | 2.0 |
| EX. 11 | NOBILTA | Silica | 40 | 2.0 |
| Comp. 1 | — | — | — | — |
| Comp. 2 | — | — | — | — |
| Comp. 3 | — | — | — | — |
| Comp. 4 | HENSCHEL | Silica | 40 | 2.0 |
| Comp. 5 | HENSCHEL | Resin | 500 | 5.0 |
| Comp. 6 | HENSCHEL | Resin | 500 | 5.0 |
| Comp. 7 | HENSCHEL | Silica | 40 | 2.0 |
| Comp. 8 | HENSCHEL | Silica | 40 | 2.0 |

Ex.: Example
Comp.: Comparative Example

Next, toners of Examples and Comparative Examples are evaluated.

SEM Observation

The existing state of the particles present on the surface of toner is observed using an SEM according to the following criteria:

E (Excellent): Particles are not embedded or detached
F (Fair): Part of particles is detached or embedded
B (Bad): Particles are embedded or detached Agglomeration Degree Screens having an opening of 22 μm, 45 μm, and 75 μm are stack up sequentially. 2 g of the toner is placed on the screen having an opening of 75 μm. The screen is vibrated by a powder tester (manufactured by Hosokawa Micron Group) with an amplitude of 1 mm for 10 seconds to drop the toner naturally. The agglomeration degree a+b+c (in %) is calculated from the weight of the toner remaining on each screen using the relationships 1 to 3.

$a$=(Weight of the toner remaining on the screen having an opening of 75 μm)/2×100 Relationship 1

$b$=(Weight of the toner remaining on the screen having an opening of 45 μm)/2×(3/5)×100 Relationship 2

$c$=(Weight of the toner remaining on the screen having an opening of 22 μm)/2×(1/5)×100 Relationship 3

The agglomeration degree is preferably from 10 to 60% and the smaller, the better.

Stress Test

A development agent composed of toner and copper-zinc ferrite particle covered with silicon resins and having an average particle diameter of 50 μm with a ratio of 4 to 96 by weight % is manufactured.

Images are printed on A4 paper at 45 sheets/minute using an image forming apparatus (imagio Neo 450, manufactured Ricoh Co., Ltd.). Images are continuously printed on the first sheet to 5,000th sheet with an image density of 5%, 5,001st sheet to 9,000th sheet with an image ratio of 0.5%, and 9,001st sheet to 10,000th sheet with an image ratio of 20%.

This mode is applied to 10,001st sheet to 100,000th sheet. The results are evaluated by the following.

Amount of Charge

Weigh six gram of the development agent and set it in a sealable metal cylinder. The amount of charge is obtained by blowing. A suitable amount of charge is from −25 to −40 μC/g.

When the absolute value of the amount of charge is too small, the background fouling and toner scattering tend to occur. When the absolute value of the amount of charge is too large, the image density tends to decrease.

Fogging

The operation of the image bearing member is stopped in the middle of printing a white image and the development agent on the image bearing member is transferred to a tape after development. The difference of the image density between the tape and a blank (non-transfer) tape is measured by 938 spectrodensitometer (manufactured by X-Rite Co., Ltd.) and evaluated as follows:

E (Excellent): Difference is less than 0.005

G (Good): 0.005 to less than 0.010

F (Fair): 0.010 to less than 0.030

B (Bad): 0.030 or more

Spent Rate

The toner is removed from the development agent by a blow-off method after the 100,000 printing to measure the weight W1 (g) of the remaining carrier.

Next, the carrier is placed in toluene and washed and dried to measure the weight W2 (g) of the dried carrier.

Spent ratio is calculated from the relationship: (W1−W2)/W1×100 and evaluated as follows: E (Excellent): Spent ratio is less than 0.01%

G (Good): 0.01% to less than 0.02%

F (Fair): 0.02% to less than 0.05%

B (Bad): 0.05% or higher

Filming

The development roller or the image bearing member is observed for toner filming and evaluated as follows:

E (Excellent): No filming

G (Good): Streak filming observed

B (Bad): Overall filming

Image Density

After outputting solid images, the image density is measured using a 938 spectrodensitometer (manufactured by X-Rite Co., Ltd.) and evaluated as follows:

E (Excellent): Image density is 1.40 or greater

G (Good): 1.30 to less than 1.40

F (Fair): 1.20 to less than 1.30

B (Bad): less than 1.20

The evaluation results of the toners of Examples and Comparative Examples are shown in Table 2.

TABLE 2

| | | | Initial | | | After 100,000 printing | | | | |
|---|---|---|---|---|---|---|---|---|---|---|
| | SEM observation | Agglomeration Degree (%) | Image density | Fogging | Amount of charge (−μC/g) | Image density | Fogging | Amount of charge (−μC/g) | Spent ratio (%) | Filming |
| EX. 1 | E | 45 | G | G | 27 | G | G | 28 | G | G |
| EX. 2 | E | 25 | G | G | 35 | G | G | 34 | G | G |
| EX. 3 | E | 24 | G | G | 34 | G | G | 32 | G | G |
| EX. 4 | E | 12 | E | E | 32 | E | E | 32 | E | E |
| EX. 5 | E | 25 | G | G | 33 | G | G | 34 | G | G |
| EX. 6 | E | 37 | G | G | 31 | G | G | 30 | G | G |
| EX. 7 | E | 20 | G | G | 33 | G | G | 32 | G | G |
| EX. 8 | E | 24 | G | G | 29 | G | G | 30 | G | G |
| EX. 9 | E | 22 | G | G | 28 | G | G | 29 | G | G |
| EX. 10 | E | 24 | G | G | 36 | G | G | 37 | G | G |
| EX. 11 | E | 15 | G | G | 33 | G | G | 31 | G | G |
| Comp. 1 | B | 36 | G | G | 27 | — | — | — | — | — |
| Comp. 2 | F | 16 | G | G | 33 | — | — | — | — | — |
| Comp. 3 | B | 48 | B | B | 18 | — | — | — | — | — |
| Comp. 4 | B | 30 | B | B | 15 | — | — | — | — | — |
| Comp. 5 | B | 27 | B | B | 16 | — | — | — | — | — |
| Comp. 6 | B | 50 | B | B | 17 | — | — | — | — | — |
| Comp. 7 | E | 32 | G | G | 28 | — | — | — | — | — |
| Comp. 8 | E | 21 | G | G | 38 | — | — | — | — | — |

As seen in Table 2, with regard to the toners of Examples 1 to 11, the silica particle RX50 (manufactured by Nippon Aerosil Co., Ltd.) having an average primary particle diameter of 40 nm) is not embedded in the stress test. The toners demonstrate stable toner function and produces quality images.

To the contrary, with regard to the toner of Comparative Example 1, the silica particle RX50 (manufactured by Nippon Aerosil Co., Ltd.) having an average primary particle diameter of 40 nm is embedded. This embedding of the silica significantly progresses because of the mechanical stress by the continuous printing on 5,001st sheet to 9,000th sheet with an image density of 0.5% in the stress test. As a result, in the continuous printing on 9,001st sheet to 10,000th sheet with an image density of 20%, contamination in the machine by toner scattering caused by bad charging and supply fogging occur at once so that the stress test is stopped.

With regard to the toner of Comparative Example 2, part of the silica particle RX50 (manufactured by Nippon Aerosil Co., Ltd.) having an average primary particle diameter of 40 nm is embedded. After printing images on 50,000 sheets, the same phenomenon as in the toner of Comparative Example 1 occurs, thereby aborting the stress test.

With regard to the toners of Comparative Examples 3 to 6, the resin particle having a negative charging property is detached from the toner. Since the resin particle having a negative charging property is attached to images in the initial state of the stress test, the stress test is stopped.

With regard to the toner of Comparative Example 7, the added amount of the resin particle having a negative charging property is too small. Therefore, the same phenomenon as in the toner of Comparative Example 1 occurs after 35,000 sheets, thereby aborting the stress test.

With regard to the toner of Comparative Example 8, the added amount of the resin particle having a negative charging property is too large. Therefore, the same phenomenon as in the toners of Comparative Examples 3 to 6 occurs after 29,000 sheets, thereby aborting the stress test.

Having now fully described the invention, it will be apparent to one of ordinary skill in the art that many changes and modifications can be made thereto without departing from the spirit and scope of the invention as set forth therein.

What is claimed is:

1. A method of manufacturing toner comprising:

mixing mother toner particles comprising a binder resin and a coloring agent and first particles having an average primary particle diameter of from 300 nm to 800 nm to obtain a mixture of the mother toner particles and the first particles using a mixer comprising a rotary shaft member, multiple stirring members provided to a surface of the shaft member, and a casing to cover the multiple stirring members, wherein a cross section of an inner periphery of the casing relative to a direction perpendicular to a rotation axis of the shaft member is circular around the rotation axis with a substantially constant distance between the inner periphery and the rotation axis in a state in which the casing covers the multiple stirring members and a cooling jacket is provided to at least part of an outer periphery of the casing, and wherein a weight ratio of the first particles to the mother toner particles is from 1.5% to 10%.

2. The method of manufacturing toner according to claim 1, further comprising mixing the mixture of the mother toner particles and the first particles with second particles having an average primary particle diameter of from 10 nm to less than 100 nm.

3. The method of manufacturing toner according to claim 2, wherein the mixer is used in the step of mixing the mixture of the mother toner particles and the first particles with the second particles.

4. The method of manufacturing toner according to claim 2, wherein a weight ratio of the second particles to the mother toner particles is from 0.1% to 5%.

5. The method of manufacturing toner according to claim 1, wherein a temperature of an atmosphere in the casing is from 50° C. lower than a glass transition temperature of the binder resin to 15° C. lower than the glass transition temperature.

6. The method of manufacturing toner according to claim 1, wherein the multiple stirring members comprising at least one first stirring member and at least one second stirring member, the first stirring member transferring the particles in a first direction substantially parallel to the rotation axis of the shaft member and the second stirring member transferring back the particles in a second direction counter to the first direction.

7. The method of manufacturing toner according to claim 1, wherein adjacent stirring members of the multiple stirring members are arranged overlapped in a direction substantially parallel to the rotation axis of the shaft member and offset from each other circumferentially in a circumferential direction of the shaft member.

8. The method of manufacturing toner according to claim 1, wherein the casing has a cylindrical form.

9. The method of manufacturing toner according to claim 1, wherein the rotation axis of the shaft member is substantially orthogonal to a vertical direction.

10. The method of manufacturing toner according to claim 1, wherein the mother toner particle further comprises a releasing agent.

11. The method of manufacturing the toner according to claim 1, wherein the mother toner particle has a glass transition temperature of from 40° C. to 65° C.

12. The method of manufacturing toner according to claim 1, wherein the mother toner particle has a volume average particle diameter of from 3 μm to 9 μm.

13. Toner manufactured by the method of manufacturing toner of claim 1.

14. A method of manufacturing toner comprising:

mixing mother toner particles comprising a binder resin and a coloring agent, first particles having an average primary particle diameter of from 300 nm to 800 nm, and second particles having an average primary particle diameter of from 10 nm to less than 100 nm using a mixer comprising a rotary shaft member, multiple stirring members provided to a surface of the shaft member, and a casing to cover the multiple stirring members, wherein a cross section of an inner periphery of the casing relative to a direction perpendicular to a rotation axis of the shaft member is circular around the rotation axis with a substantially constant distance between the inner periphery and the rotation axis in a state in which the casing covers the multiple stirring members and a cooling jacket is provided to at least part of an outer periphery of the casing, and wherein a weight ratio of the first particles to the mother toner particles is from 1.5% to 10%.

15. The method of manufacturing toner according to claim 14, wherein a weight ratio of the second particles to the mother toner particles is from 0.1% to 5%.

16. Toner manufactured by the method of manufacturing toner of claim 14.

17. A method of manufacturing toner comprising:

mixing mother toner particles comprising a binder resin and a coloring agent and second particles having an average primary particle diameter of from 10 nm to less than 100 nm to obtain a mixture of the mother toner particles and the second particles; and mixing the mixture and first particles having an average primary particle diameter of from 300 nm to 800 nm using a mixer comprising a rotary shaft member, multiple stirring members provided to a surface of the shaft member, and a casing to cover the multiple stirring members, wherein a cross section of an inner periphery of the casing relative to a direction perpendicular to a rotation axis of the shaft member is circularly around the rotation axis with a substantially constant distance between the inner periphery and the rotation axis in a state in which the casing covers the multiple stirring members and a cooling jacket is provided to at least part of an outer periphery of the casing; and wherein a weight ratio of the first particles to the mother toner particles is from 1.5% to 10%.

18. The method of manufacturing toner according to claim 16, wherein the mixer is used in the step of mixing the mother toner particles and the second particles to obtain the mixture.

19. The method of manufacturing toner according to claim 16, wherein a weight ratio of the second particles to the mother toner particles is from 0.1% to 5%.

20. Toner manufactured by the method of manufacturing toner of claim 17.

* * * * *